US006505627B2

(12) United States Patent
Kittelsen et al.

(10) Patent No.: US 6,505,627 B2
(45) Date of Patent: Jan. 14, 2003

(54) COMPOSITE MOUTHGUARD WITH PALATE ARCH AND ANTERIOR PALATE OPENING

(76) Inventors: Jon D. Kittelsen, 1511 Innsbruck Dr. North, Fridley, MN (US) 55432; Henry D. Cross, III, 546 Old Field Rd., Mt. Gilead, Murrell's Inlet, SC (US) 29576; Paul C. Belvedere, 5824 Creek Valley Rd., Edina, MN (US) 55436-1212; Mark Herman, 1400 Lincoln, Minneapolis, MN (US) 55403

( * ) Notice: Subject to any disclaimer, the term of this patent is extended or adjusted under 35 U.S.C. 154(b) by 0 days.

(21) Appl. No.: 09/828,103

(22) Filed: Apr. 6, 2001

(65) Prior Publication Data

US 2002/0144687 A1 Oct. 10, 2002

(51) Int. Cl.[7] ..... A61C 5/14

(52) U.S. Cl. ..... 128/859; 128/861; 128/862

(58) Field of Search ..... 128/846, 878, 128/859–862; 602/902; 433/6

(56) References Cited

U.S. PATENT DOCUMENTS

| | | | |
|---|---|---|---|
| 257,038 | A | 4/1882 | McMann |
| 1,117,928 | A | 11/1914 | Thurmond |
| 1,323,832 | A | 12/1919 | Chige |
| 1,461,209 | A | 7/1923 | Bridges |
| 1,470,888 | A | 10/1923 | Smedley |
| 1,487,392 | A | 3/1924 | Lee |
| 2,118,980 | A | 5/1938 | Montgomery et al. |
| 2,257,709 | A | 9/1941 | Anderson |
| 2,423,005 | A | 6/1947 | Chaiken |
| 2,630,117 | A | 3/1953 | Coleman |
| 2,643,652 | A | 6/1953 | Cathcart |
| 2,659,366 | A | 11/1953 | Savarese |
| 2,669,988 | A | 2/1954 | Carpenter |
| 2,678,043 | A | 5/1954 | Stark |
| 2,694,397 | A | 11/1954 | Herms |
| 2,702,032 | A | 2/1955 | Freedland |
| 2,708,931 | A | 5/1955 | Freedland |
| 2,750,941 | A | 6/1956 | Cathcart |
| 2,833,278 | A | 5/1958 | Ross |

(List continued on next page.)

FOREIGN PATENT DOCUMENTS

| | | |
|---|---|---|
| CA | 1147583 | 6/1983 |
| DE | 480423 | 7/1929 |

OTHER PUBLICATIONS

Mouth Protectors: Give Your Teeth a Sporting Chance, American Dental Association, 1985.

Stephen D. Smith, D.M.D., Muscular Strength Correlated to Jaw Posture and the Temporomandibular Joint, New York State Dental Journal, vol. 44, No. 7, Aug.–Sep. 1978.

W.B. May, D.D.S., Reduction of Stress in the Chewing Mechanism–Part III.

*Primary Examiner*—Michael A. Brown

(74) *Attorney, Agent, or Firm*—Gerald E. Helget; Nelson R. Capes; Briggs and Morgan

(57) ABSTRACT

A performance enhancing and force absorbing mouthguard adapted to fit the upper teeth of the mouth of an athlete wherein the mouthguard is quadruple or quintuple composite material of distinct materials. The first internal layer is a non-softenable flexible framework which will permit the mouthguard to hold its shape during fitting as well as to absorb and dissipate significant impact conveyed to the upper teeth. A hard, durable reverse bite plate wedge is thicker rearwardly and lowers the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. While the framework, wedge and traction pads are mechanically interlocked, a softenable material is placed over the mouthguard excepting the contact portions of the traction pads to encapsulate the mouthguard and to permit custom fitting.

6 Claims, 7 Drawing Sheets

U.S. PATENT DOCUMENTS

| | | | |
|---|---|---|---|
| 2,847,003 | A | 8/1958 | Helmer et al. |
| 2,933,811 | A | 4/1960 | Lifton |
| 2,966,908 | A | 1/1961 | Cathcart et al. |
| 3,016,052 | A | 1/1962 | Zubren |
| 3,058,462 | A | 10/1962 | Greenblum |
| 3,073,300 | A | 1/1963 | Berghash |
| 3,082,765 | A | 3/1963 | Helmer |
| 3,107,667 | A | 10/1963 | Moore |
| 3,124,129 | A | 3/1964 | Grossberg |
| 3,126,002 | A | 3/1964 | Owens |
| 3,203,417 | A | 8/1965 | Helmer |
| 3,207,153 | A | 9/1965 | Goldstein |
| 3,223,085 | A | 12/1965 | Gores et al. |
| 3,247,844 | A | 4/1966 | Berghash |
| 3,312,218 | A | 4/1967 | Jacobs |
| 3,319,626 | A | 5/1967 | Lindsay |
| 3,407,809 | A | 10/1968 | Ross |
| 3,411,501 | A | 11/1968 | Greenberg |
| 3,416,527 | A | 12/1968 | Hoef |
| 3,448,738 | A | 6/1969 | Berghash |
| 3,457,916 | A | 7/1969 | Wolicki |
| 3,485,242 | A | 12/1969 | Greenberg |
| 3,496,936 | A | 2/1970 | Gores |
| 3,505,995 | A | 4/1970 | Greenberg |
| 3,513,838 | A | 5/1970 | Foderick et al. |
| 3,518,988 | A | 7/1970 | Gores |
| 3,532,091 | A | 10/1970 | Lerman |
| 3,682,164 | A | 8/1972 | Miller |
| 3,692,025 | A | 9/1972 | Greenberg |
| 3,768,465 | A | 10/1973 | Helmer |
| 3,864,832 | A | 2/1975 | Carlson |
| 3,916,527 | A | 11/1975 | Linkow |
| 3,924,638 | A | 12/1975 | Mann |
| 3,943,924 | A | 3/1976 | Kallestad et al. |
| 4,030,493 | A | 6/1977 | Walters et al. |
| 4,044,762 | A | 8/1977 | Jacobs |
| 4,063,552 | A | 12/1977 | Going et al. |
| 4,114,614 | A | 9/1978 | Kesling |
| 4,185,817 | A | 1/1980 | Peterson |
| 4,211,008 | A | 7/1980 | Lerman |
| 4,330,272 | A | 5/1982 | Bergersen |
| 4,337,765 | A | 7/1982 | Zimmerman |
| 4,348,178 | A | 9/1982 | Kurz |
| 4,376,628 | A | 3/1983 | Aardse |
| 4,457,708 | A | 7/1984 | Dufour |
| 4,490,112 | A | 12/1984 | Tanaka et al. |
| 4,495,945 | A | 1/1985 | Liegner |
| 4,519,386 | A | 5/1985 | Sullivan |
| 4,568,280 | A | 2/1986 | Ahlin |
| 4,591,341 | A | 5/1986 | Andrews |
| 4,640,273 | A | 2/1987 | Greene et al. |
| 4,671,766 | A | 6/1987 | Norton |
| 4,672,959 | A | 6/1987 | May et al. |
| 4,727,867 | A | 3/1988 | Knoderer |
| 4,755,139 | A | 7/1988 | Abbatte et al. |
| 4,763,791 | A | 8/1988 | Halverson et al. |
| 4,765,324 | A | 8/1988 | Lake, Jr. |
| 4,791,941 | A | 12/1988 | Schaefer |
| 4,793,803 | A | 12/1988 | Martz |
| 4,799,500 | A | 1/1989 | Newbury |
| 4,810,192 | A | 3/1989 | Williams |
| 4,838,283 | A | 6/1989 | Lee, Jr. |
| 4,848,365 | A | 7/1989 | Guarlotti et al. |
| 4,867,147 | A | 9/1989 | Davis |
| 4,944,947 | A | 7/1990 | Newman |
| 4,955,393 | A | 9/1990 | Adell |
| 4,976,618 | A | 12/1990 | Anderson |
| 4,977,905 | A | 12/1990 | Kittelsen et al. |
| 4,989,616 | A | 2/1991 | Lee, Jr. |
| 5,031,611 | A | 7/1991 | Moles |
| 5,031,638 | A | 7/1991 | Castaldi |
| 5,063,940 | A | 11/1991 | Adell et al. |
| 5,076,785 | A | 12/1991 | Tsai |
| 5,082,007 | A | 1/1992 | Adell |
| 5,103,838 | A | 4/1992 | Yousif |
| 5,112,225 | A | 5/1992 | Diesso |
| 5,117,816 | A | 6/1992 | Shapiro |
| D328,494 | S | 8/1992 | Schwendeman et al. |
| 5,152,301 | A | 10/1992 | Kittelsen et al. |
| 5,154,609 | A | 10/1992 | George |
| 5,165,424 | A | 11/1992 | Silverman |
| 5,174,284 | A | 12/1992 | Jackson |
| 5,194,003 | A | 3/1993 | Garay et al. |
| 5,194,004 | A | 3/1993 | Bergersen |
| 5,203,351 | A | 4/1993 | Adell |
| 5,234,005 | A | 8/1993 | Kittelsen et al. |
| 5,235,991 | A | 8/1993 | Minneman |
| 5,259,762 | A | 11/1993 | Farrell |
| 5,277,203 | A | 1/1994 | Hays |
| D343,928 | S | 2/1994 | Kittelsen |
| 5,293,880 | A | 3/1994 | Levitt |
| 5,297,960 | A | 3/1994 | Burns |
| 5,299,936 | A | 4/1994 | Ueno |
| 5,302,117 | A | 4/1994 | Kraut et al. |
| 5,313,960 | A | 5/1994 | Tosasi |
| 5,316,474 | A | 5/1994 | Robertson |
| 5,320,114 | A | 6/1994 | Kittelsen et al. |
| 5,323,787 | A | 6/1994 | Pratt |
| 5,328,362 | A | 7/1994 | Watson et al. |
| 5,336,086 | A | 8/1994 | Simmen |
| 5,339,832 | A | 8/1994 | Kittelsen et al. |
| 5,353,810 | A | 10/1994 | Kittelsen et al. |
| 5,365,946 | A | 11/1994 | McMillan |
| 5,385,155 | A | 1/1995 | Kittelsen et al. |
| 5,386,821 | A | 2/1995 | Poterack |
| D356,188 | S | 3/1995 | Kittelsen |
| 5,401,234 | A | 3/1995 | Libin |
| 5,406,963 | A | 4/1995 | Adell |
| 5,447,168 | A | 9/1995 | Bancroft |
| 5,460,527 | A | 10/1995 | Kittelsen |
| 5,469,865 | A | 11/1995 | Minneman |
| 5,490,520 | A | 2/1996 | Schaefer et al. |
| 5,511,562 | A | 4/1996 | Hancock |
| 5,513,656 | A | 5/1996 | Boyd, Sr. |
| 5,533,524 | A | 7/1996 | Minneman |
| D373,421 | S | 9/1996 | Brown |
| 5,566,684 | A | 10/1996 | Wagner |
| 5,584,687 | A | 12/1996 | Sullivan |
| 5,586,562 | A | 12/1996 | Matz |
| 5,590,643 | A | 1/1997 | Flam |
| 5,592,951 | A | 1/1997 | Castagnaro |
| 5,624,257 | A | 4/1997 | Farrell |
| 5,636,379 | A | 6/1997 | Williams |
| 5,646,216 | A | 7/1997 | Watson et al. |
| 5,649,534 | A | 7/1997 | Briggs, III |
| 5,666,973 | A | 9/1997 | Walter |
| 5,692,523 | A | 12/1997 | Croll et al. |
| 5,718,243 | A | 2/1998 | Weatherford et al. |
| 5,718,575 | A | 2/1998 | Cross, III |
| 5,730,599 | A | 3/1998 | Pak |
| 5,746,221 | A | 5/1998 | Jones et al. |
| D397,442 | S | 8/1998 | Kittelsen |
| 5,816,255 | A | 10/1998 | Fishman et al. |
| 5,819,744 | A | 10/1998 | Stoyka, Jr. |
| 5,823,193 | A | 10/1998 | Singer et al. |
| 5,823,194 | A | 10/1998 | Lampert |
| 5,826,581 | A | * 10/1998 | Yoshida ..... 128/862 |
| 5,836,761 | A | 11/1998 | Belvedere et al. |
| 5,865,619 | A | 2/1999 | Cross, III et al. |
| 5,873,365 | A | 2/1999 | Brown |
| 5,879,155 | A | 3/1999 | Kittelsen |

5,915,385 A 6/1999 Hakimi
5,921,240 A 7/1999 Gall
5,931,164 A 8/1999 Kiely et al.
5,947,918 A 9/1999 Jones et al.
5,970,981 A 10/1999 Ochel
6,012,919 A 1/2000 Cross, III et al.
6,036,487 A 3/2000 Westerman
6,039,046 A 3/2000 Swartz et al.
6,068,475 A 5/2000 Stoyka, Jr.
6,082,363 A 7/2000 Washburn
6,092,524 A 7/2000 Barnes, Sr.
6,098,627 A 8/2000 Kellner et al.
6,109,266 A 8/2000 Turchetti
6,152,138 A * 11/2000 Brown ..... 128/859
6,327,601 B1 * 5/2001 Kittelsen ..... 128/859
6,257,239 B1 * 7/2001 Kittelsen ..... 128/861

* cited by examiner

COMPOSITE MOUTHGUARD WITH PALATE ARCH AND ANTERIOR PALATE OPENING

BACKGROUND OF THE INVENTION

This invention generally relates to a performance enhancing and force absorbing composite mouthguard for use by athletes, and more particularly to such an adjustable customizable mouthguard appliance that spaces apart the teeth to absorb shock and clenching stress to protect the anterior and posterior teeth of the upper jaw, to lessen condyle pressure force and impact upon the cartlidge and temporomandibular joints, the arteries and the nerves and to further increase body muscular strength and endurance.

A number of mouthguards currently exist in the art for protecting the teeth and for reducing the chance of shock, concussions and other injuries as a result of high impact collisions and blows during athletic competition. Mouthguards generally are characterized as being non-personalized, universal and stock model type, or are formed to have direct upper jaw tooth-formed contact. These are customizable mouthguards.

Additionally, the mouthguards may be tethered or untethered. Mouthguards may be tethered to a fastening point, such as a helmet or face guard, to prevent the chance of the mouthguard from being lost as well as to prevent swallowing of the mouthguard or choking on the mouthguard by the user.

The lack of a mouthguard or the use of an improperly fitted mouthguard, when impacts, collisions or blows occur to the jaw structure of an athlete, have recently been found to be responsible for illnesses or injuries. Such injured athletes are susceptible to headaches, presence of earaches, ringing in the ears, clogged ears, vertigo, concussions and dizziness. The cause of these types of health problems and injuries are generally not visible by inspection of the mouth or the jaw but more particularly relate to the temporomandibular joint (TMJ) and surrounded tissues where the lower jaw is connected to the skull in the proximity where the auriculo-temporalis nerves and supra-temporo arteries pass from the neck into the skull to the brain.

In addition to protection of the teeth and the TMJ, athletes clench their teeth during exertion which results in hundreds of pounds of compressed force exerted from the lower jaw onto the upper jaw. Such clenching can result in headaches, muscle spasms, damage to teeth, injury to the TMJ and pain in the jaw. Furthermore, clenching of the teeth makes breathing more difficult during physical exercise and endurance when breathing is most important.

Most importantly, many problems exist with prior mouthguards. Mouthguards with a rigid labial or buccal walls do accept wide teeth, were bulky and had sharp edges. When the custom appliances were placed in hot water to soften for fitting, the mouthguards tended to collapse and permit portions to touch and stick together upon removal from the hot water thus making fitting of such mouthguards always a problem. Delamination and chewing destruction caused short life of the mouthguards.

There is a need for a mouthguard that solves all of the problems disclosed and will further achieve improved performance and long life as well as being easy to fit for the wearer.

SUMMARY OF THE INVENTION

A performance enhancing and force absorbing mouthguard adapted to fit the upper teeth of the mouth of an athlete wherein the mouthguard is quadruple or quintuple composite material of distinct materials. The first internal layer is a non-softenable flexible framework which will permit the mouthguard to hold its shape during fitting as well as to absorb and dissipate significant impact conveyed to the upper teeth. A hard, durable reverse bite plate wedge is thicker rearwardly and lowers the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. While the framework, wedge and traction pads are mechanically interlocked, a softenable material is placed over the mouthguard excepting the contact portions of the traction pads to encapsulate the mouthguard and to permit custom fitting.

The principle object and advantage of the present invention is that the mouthguard is that it protects the teeth, jaw, gums, connective tissues, back, head and muscles from concussive impact or blows to the jaw or teeth typically occurring during athletic activity.

Another object and advantage of the present invention is that the materials are substantially mechanically interlocked as well as encapsulated thereby preventing the possibility of delamination or separation of the materials which otherwise may occur during chewing of the mouthguard by the wearer.

Another object and advantage of the present invention is that the mouthguard places the lower jaw in the power position moving the condyle downwardly and forwardly away from the nerves and arteries within the fossia or socket to raise body muscular strength, greater endurance, improved performance by the mouthguard user as well as offer protection against concussive impacts.

Another object and advantage of the present invention is that the mouthguard is customizable to fit the width and configurations of the upper posterior teeth and palate structure of any user. That is, the mouthguard permits customizable fitting, including twisting, contraction and expansion, to permit the various tooth widths, spacing from one side of the mouth to the other side of the mouth, and palate height which also vary substantially from person to person.

Another object and advantage of the present invention is that it has a tough, rubbery elastomeric, unpenetrable bottom layer or traction pad which engages and grips the posterior teeth of the lower jaw and which further prevents the appliance from being chewed through to thereby assure long life to the appliance.

Another object and advantage of the present invention is that the framework of a non-softenable flexible material supports the appliance after heating to maintain shape and to guide the upper teeth during the fitting process.

Another object and advantage of the present invention is that the hard durable reverse bite plate wedge is of a hard very durable material that acts as a bite plate reverse wedge or fulcrum that cannot the penetrated by teeth thereby giving the appliance a longer life cycle.

Another object and advantage of the present invention is that the softenable fourth material extends over the framework wedge and non-exposed portion of the traction pads providing for the formation of a smooth mouthguard with greatly increased comfort and the avoidance of sharp edges.

Another object and advantage of the present invention is that the labial and lingual walls are not rigid allowing the user to manipulate the softenable material and to custom fabricate the mouthguard to accommodate proper fitting and to achieve more comfortable and less intrusive presence in the wearers mouth.

Another object and advantage of the present invention is that an anti-microbial ingredient keeps the appliance free of germs, fungus, virus, yeast and bacteria and also may treat gum disease.

BRIEF DESCRIPTION OF THE DRAWINGS

FIG. 7 is a bottom plan view of the mouthguard partially broken away.

DETAILED DESCRIPTION OF THE PREFERRED EMBODIMENT

Figure 1:
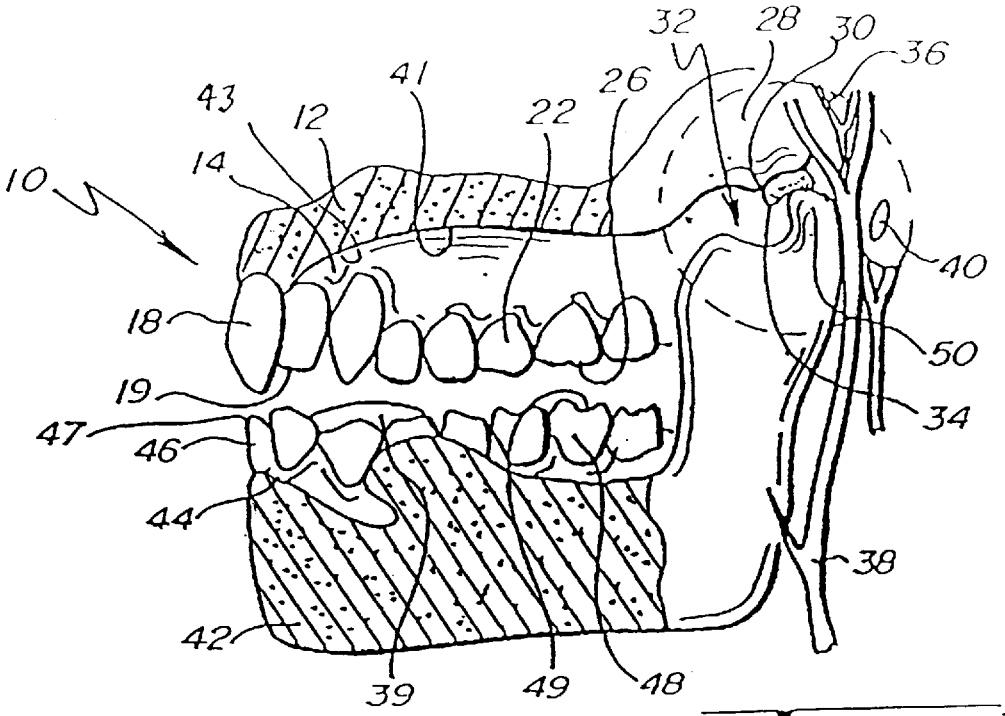
FIG. 1 is a maxillary mandibular buccal or partial side elevational view of the jaws and temporomandibular joint of the user of the mouthguard of the present invention.
Figure 1A:
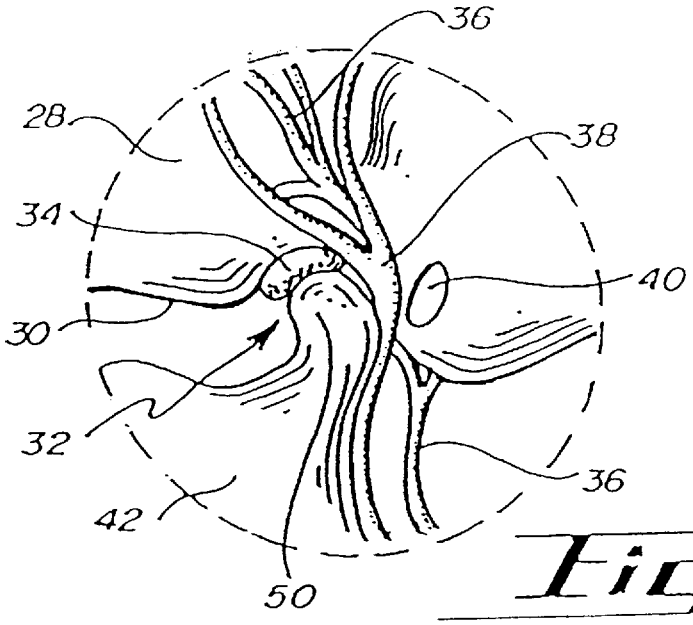
FIG. 1A is an enlarged view of the temporomandibular joint portion of FIG. 1.
Figure 2:
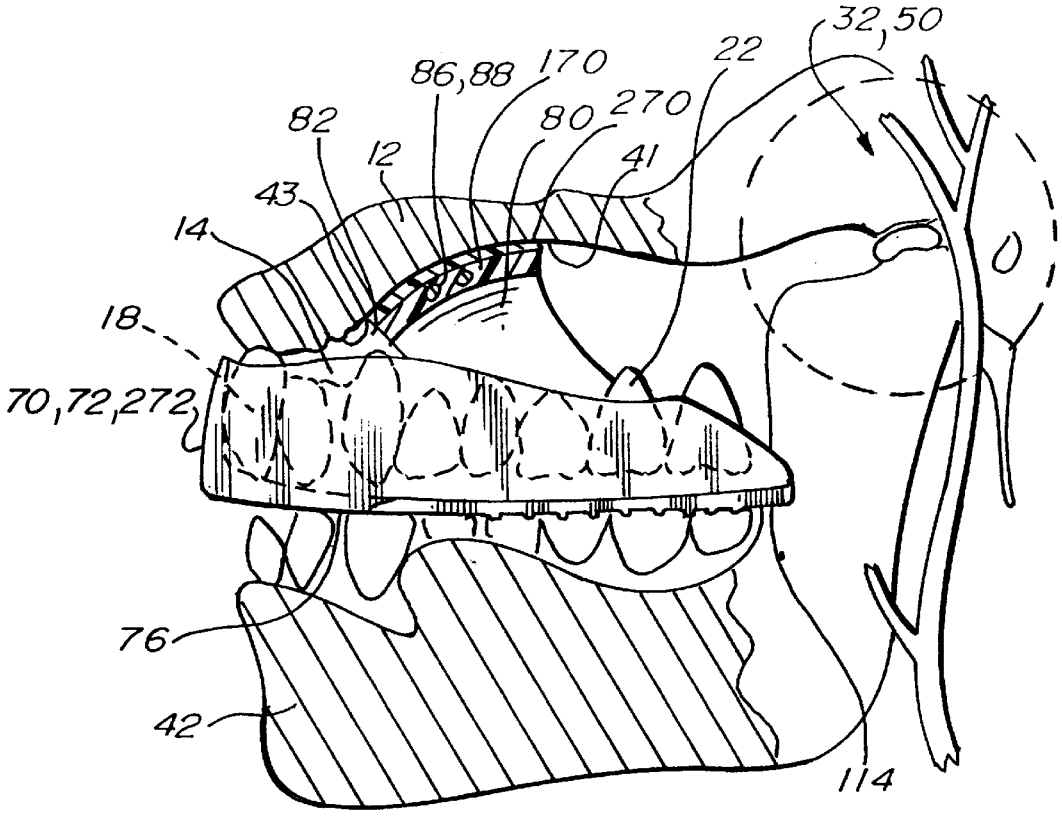
FIG. 2 is similar to FIG. 1 but shows the mouthguard of the present invention in place.
Figure 6:
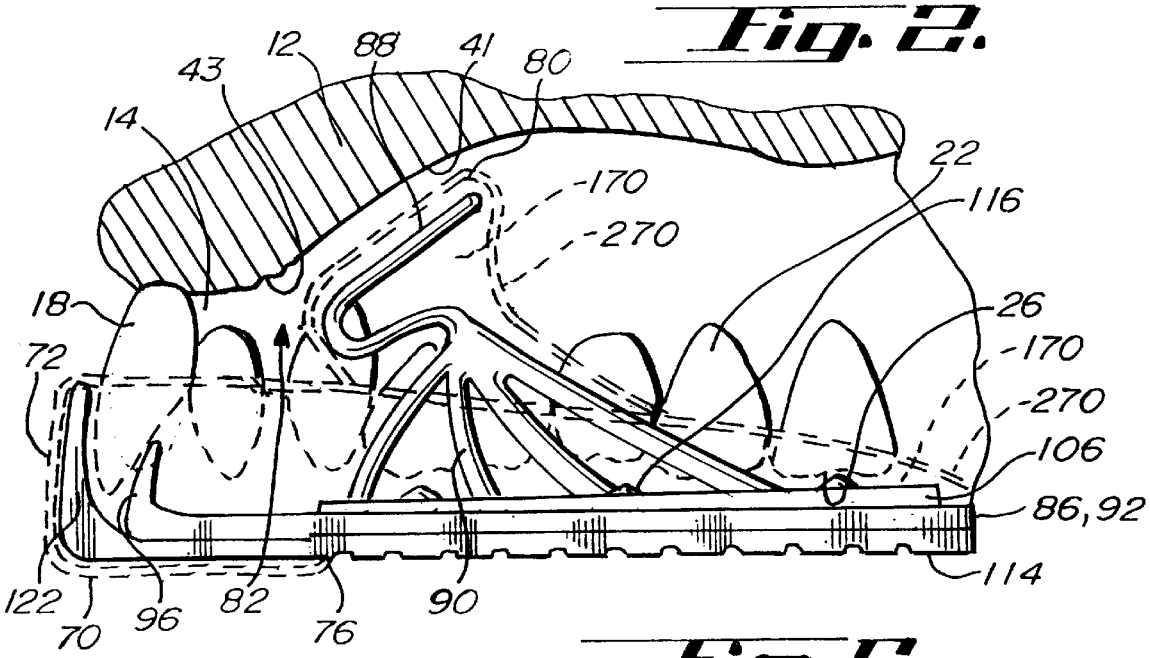
FIG. 6. is a side elevational view of the mouthguard in place on the teeth of the upper jaw partially broken away.
Figure 4:
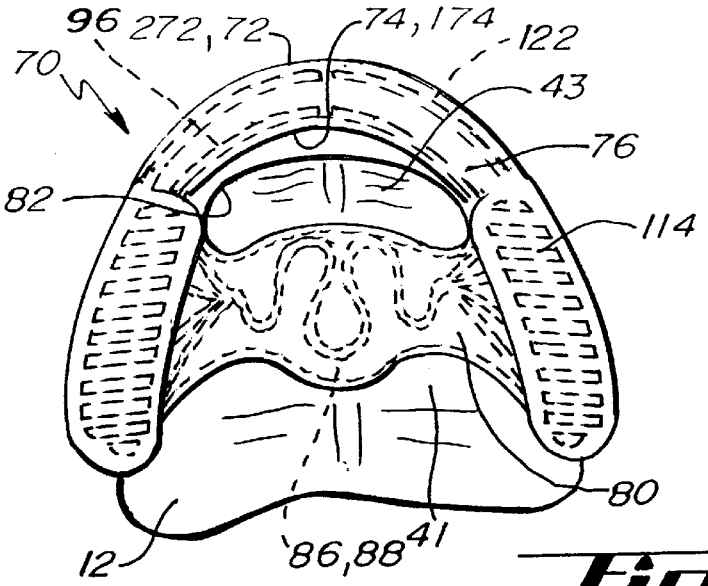
FIG. 4 is a bottom plan view of the mouthguard in place on the teeth of the upper jaw.
Figure 3:
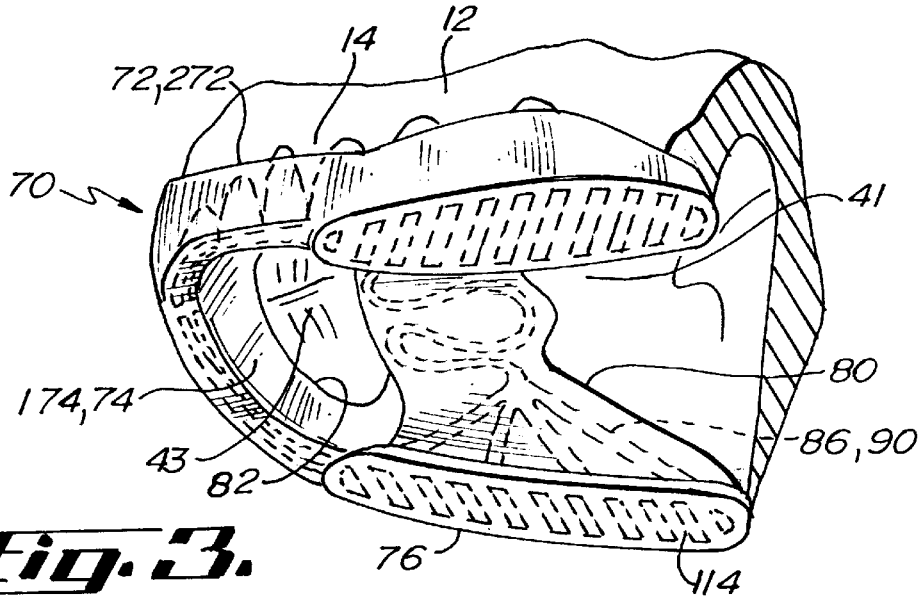
FIG. 3 is a bottom perspective view of the mouthguard in place on the teeth of the upper jaw.
Figure 9:
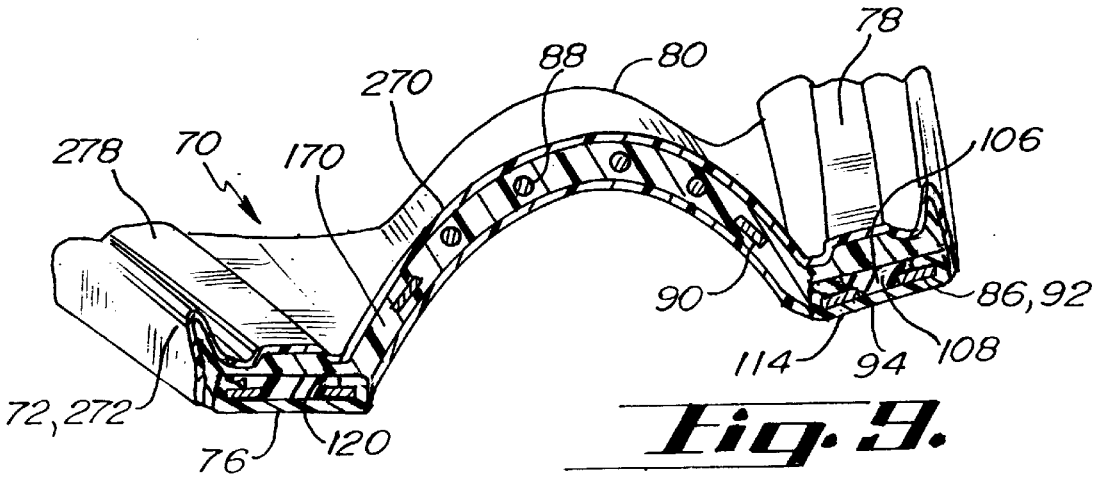
FIG. 9 is a cross-sectional view taken along lines 9—9 of FIG. 7.
Figure 5:
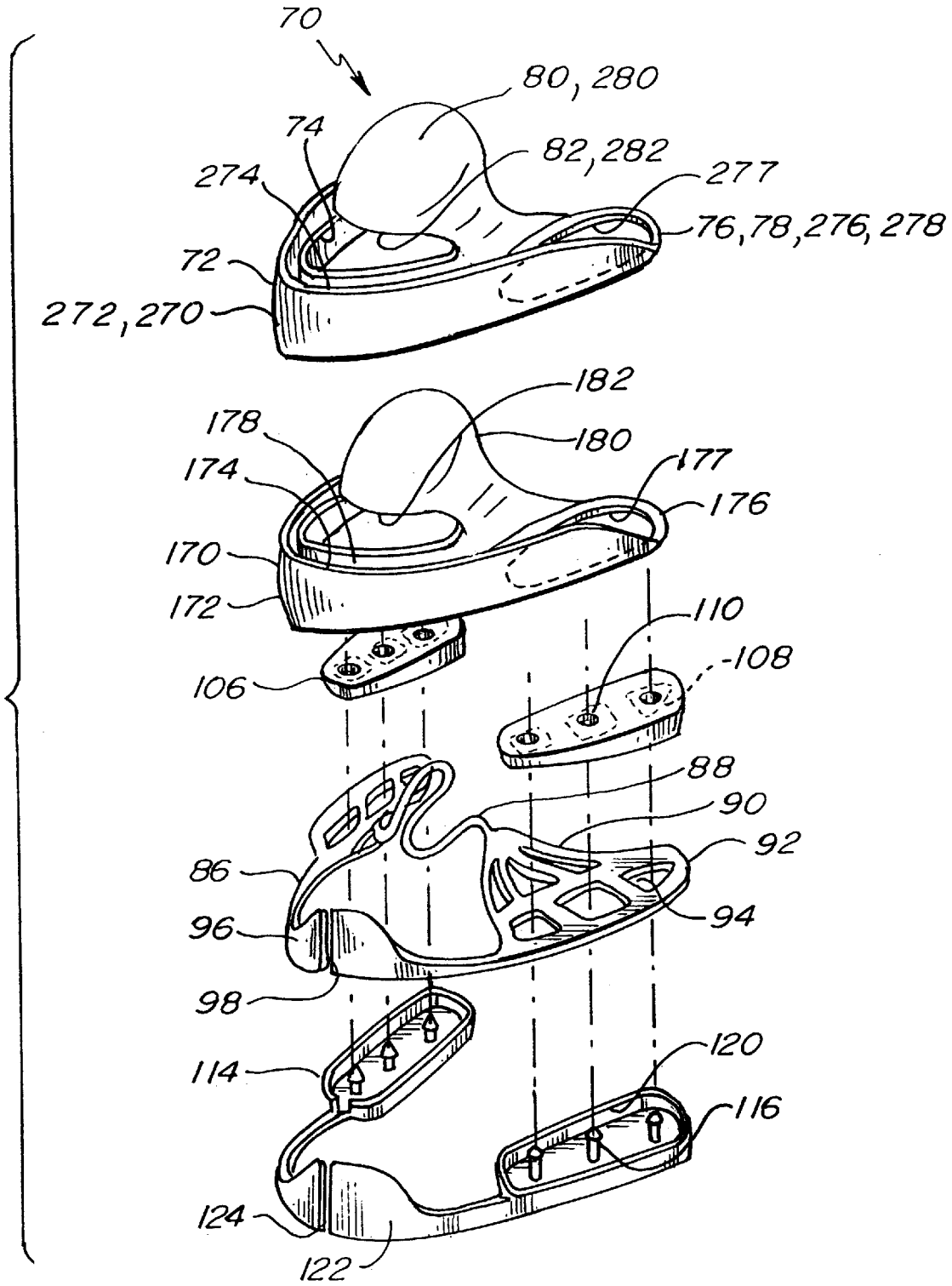
FIG. 5 is an exploded perspective view of the mouthguard of the present invention.
Figure 4:
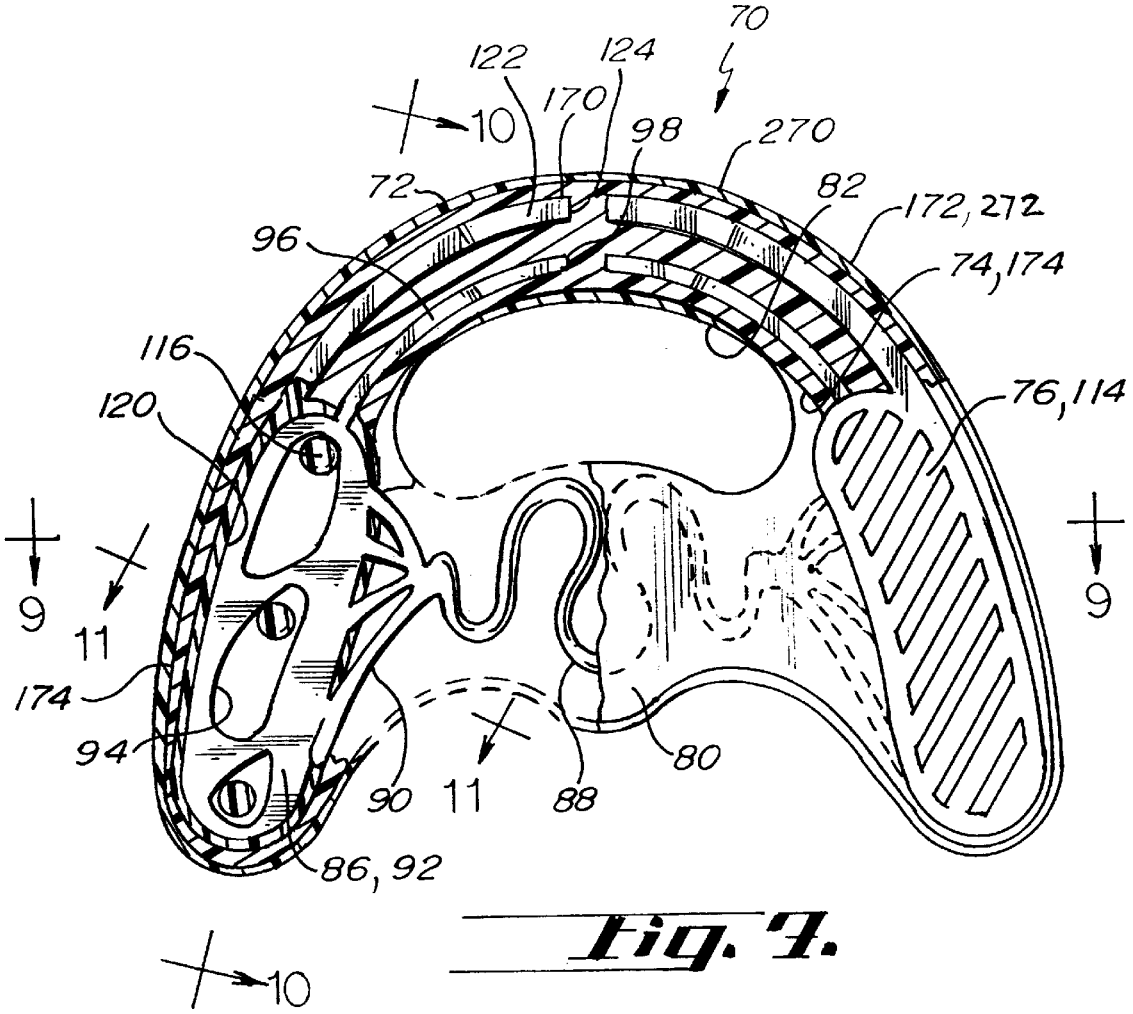
Figure 8:
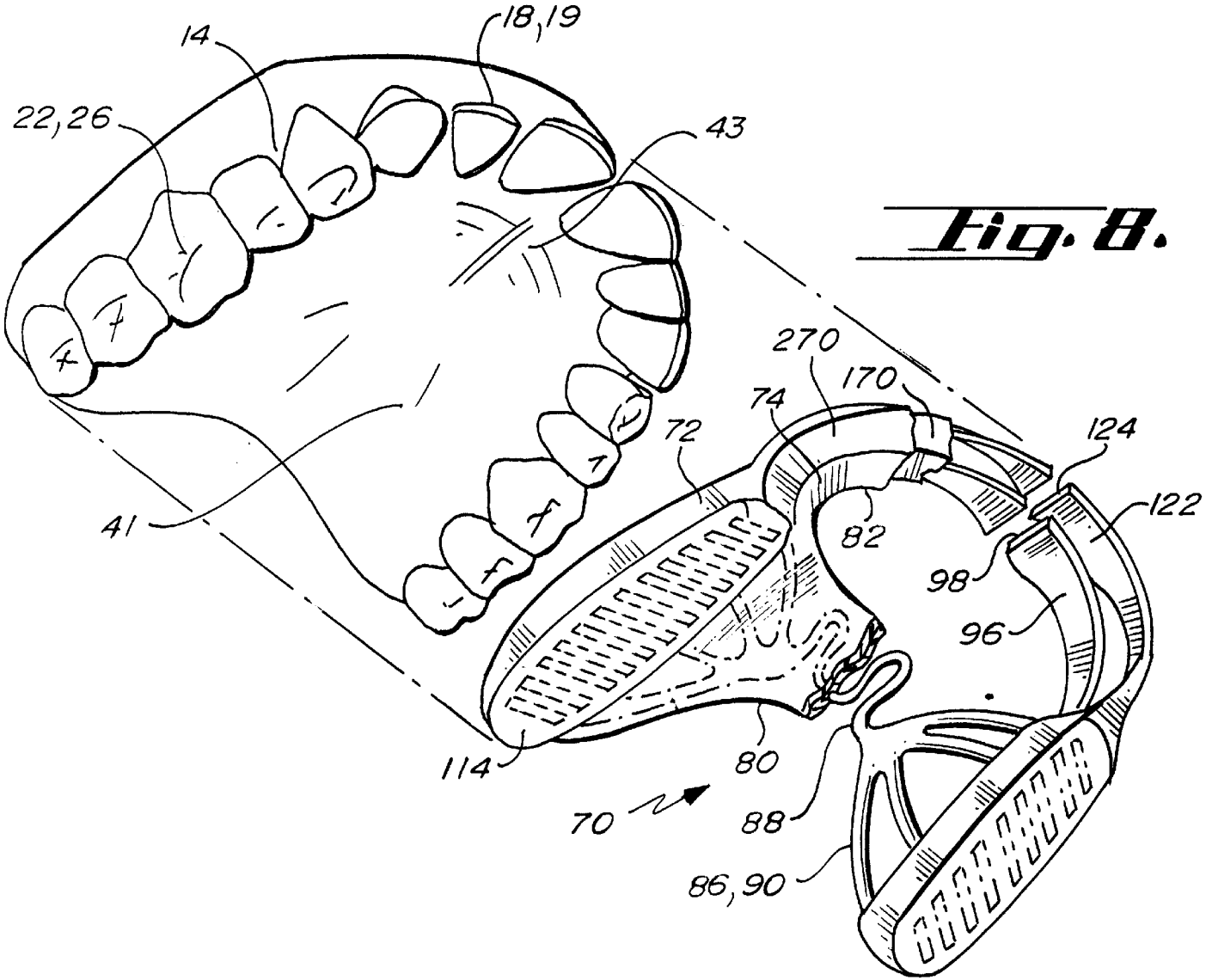
FIG. 8 is an exploded partially broken away view of the mouthguard aligned for fitting on the teeth of the upperjaw.
Figure 10:
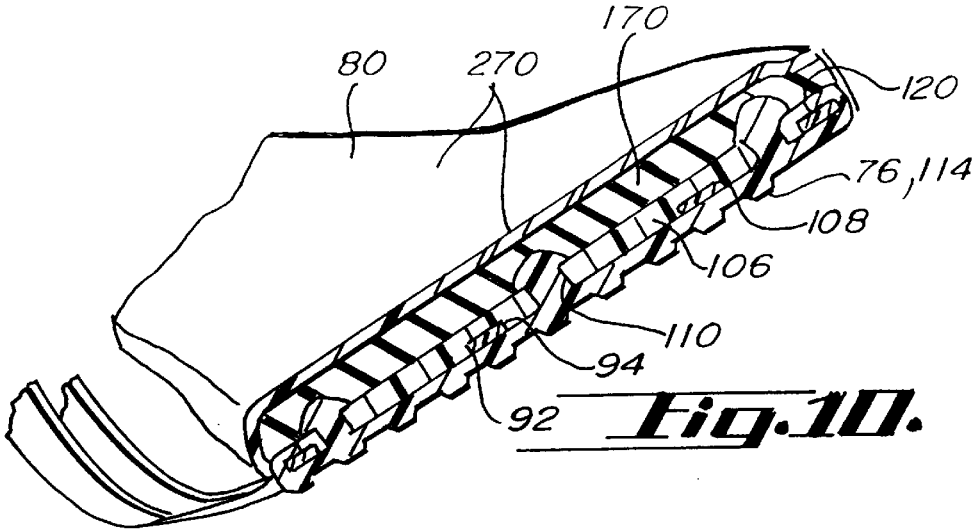
FIG. 10 is a cross-sectional view taken along lines 10—10 of FIG. 7.
Figure 11:
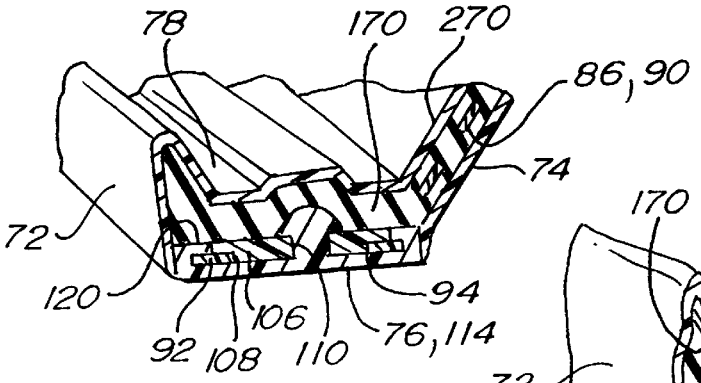
FIG. 11 is a cross-sectional view taken along lines 11—11 FIG. 7.
Figure 12:
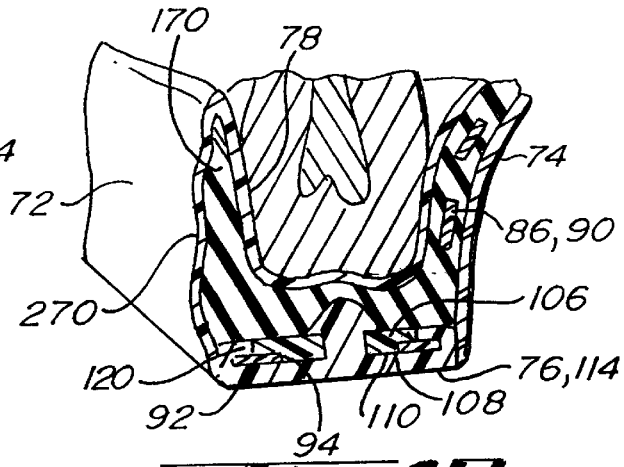
FIG. 12 is an enlarged broken away view similar to FIG. 11 with the mouthguard fitted to the teeth of the wearer.
Figure 11A:
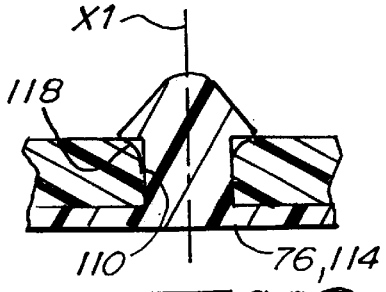
FIG. 11A is an enlarged view broken away of the mechanical interlock shown in FIG. 11.

To understand the structural features and benefits of the dental appliance or mouthguard 70 of the present invention, some anatomy will first be described. Referring to FIGS. 1 and 1A, the user or athlete has a mouth 10 generally comprised of a rigid upper jaw 12 and a movable lower jaw 42 which are movably connected at the temporomandibular joint (TMJ) 32 and 50.

More specifically, the rigid upper jaw 12 has gum tissue 14 within mouth 10. Gum tissue 14, as well as the bone thereunder, supports anterior teeth (incisors and canines) 18 which have incisal or biting surfaces 19. The gum tissues 14 and the bone thereunder also support posterior teeth (molars and bicuspids) 22 which have cusps or biting surfaces 26.

Referring to one side of the human head, the temporal bone 28 is located upwardly and rearwardly of the upper jaw 12 and is in the range of $1/16^{th}$ to $1/32^{nd}$ inch thick. The articular eminence 30 forms the beginning of the fossae 32 or the socket of the temporomandibular joint 32 and 50.

Rearwardly and posteriorly to the articular eminence 30 is located cartilage 34. Through the temporomandibular joint 32 and 50 pass the ariculo-temporalis nerve 36 and supra-temporo artery 38. Posteriorly to this structure is located the inner ear 40. Within the mouth is located tongue 39 and the roof or hard palate 41, which terminates rearwardly into the soft palate and forwardly into the anterior palate or ruggae 43. The ruggae 43 has a rib surface which is identifiable by the fingers or tongue 39. The tongue touches the ruggae 43 during speech.

The movable jaw or mandible 42 supports a bone covered by gum tissue 44 which further supports anterior teeth (incisors and canines) 46 with incisal or biting surfaces 47 and posterior teeth (molars and bicuspids) 48 with occlusal biting surfaces 49. The condyle 50 of the lower jaw 42 forms the ball of the temporomandibular joint 32 and 50. The anatomical structure is the same for both sides of the head.

Repeated impacts, collisions, blows, stress or forces exerted on the movable lower jaw 42 results in excessive wearing forced upon the condyle 50 and the cartilage, meniscus, or disc 34—typically resulting in bone deterioration on the head of the condyle or slippage and compressive damage of the cartilage 34. Thereafter, the lower jaw 42 may be subject to irregular movement, pain, loss of comfortable range of movement, and clicking of the joint 32 and 50.

The ariculo-temporalis nerve 36 relates to both sensory and motor activity of the body. Any impingement or pinching of this nerve 36 can result in health problems as previously mentioned. This supra-temporal artery 38 is important in that provides blood circulation to portions of the head. Impingement, pinching, rupture or blockage of this artery 38 will result in possible loss of consciousness and reduced physical ability and endurance due to the restriction of blood flow to portions of the brain. Thus, it I extremely important to assure that the condyle 50 does not impinge upon the ariculo-temporalis nerve 36 or the supra-temporal artery 38. It is also important to note that the temporal bone 28 is not too thick in the area of the glenoid fossae. Medical science has shown that a sharp shock, stress or concussive force applied to the lower jaw 42 possibly could result in the condyle 50 pertruding through the glenoid fossae of the temporal bone 28 thereby causing death. This is a suture line (growth and development seam) in the glenoid fossae, resulting in a possible weakness in the fossae in many humans. This incident rarely, but sometimes, occurs with respect to boxing athletes.

The mouthguard of the present invention is shown in the Figures as reference number 70.

Mouthguard 70 is generally u-shaped and is comprised of labial wall 72, lingual wall 74 which are upstanding from base 76 and channel 78 is formed by this arrangement.

Specifically referring to FIGS. 2 through 8, the mouthguard comprises at least four layers of distinct material 86, 106, 114 and 170. The framework 86 is a non-softenable flexible material to assist in maintaining the shape of the heated mouthguard 70 and to permit the sizing of the mouthguards by way of twisting, expansion and contraction for variously configured mouths. The reverse bite plate wedge or fulcrum 106 is of a hard durable material permitting displacement of the condyle and proper positioning of the lower jaw 42. The traction pads 114 are elastomeric and therefore rubbery and grippable. The encapsulating material 170 is softenable and forms walls 72 and 74, channel 78 and arch 180 where applicable. The portion of the mouthguard 70 softens when heated and permits custom fitting of the mouthguard 72 in a particular mouth configuration. Optionally, an ethylene vinyl acetate skin 270 may be laid over the entire mouthguard to encapsulate it only exposing the traction pad portions 114 which will engage the molars 48 of the lower jaw 42.

The first shot of the mouthguard 70 is comprised of the non-softenable, flexible framework 86 which is suitably made of polypropylene which exhibits a rigid character in that it holds its shape and can handle hot water because its melting point is 380° F. The material also has excellent bonding qualities with other copolymers. The polypropylene part number appropriate for the framework 86 is AP6112-HS from Huntsman Corporation, Chesapeake, Va. 23320.

The framework 86 suitably may have connecting belevedere bridge 88 which spans across in an arch like manner across the roof or hard palate 41 of the mouth 10. The bridge 88 then connects to cross-cantilever connectors 90 which connect to occlusal pad plates 92 in various places to assure the relative stability of the framework 86. The occlusal pad plates 92 have index openings 94 therethrough. Extending forwardly from the plates 92 are disconnected adjustable anterior impact braces 96 with a gap 98 therethrough. The anterior impact braces dissipate concussive blows or impacts to the front of the mouth 10 supporting the anterior teeth 18 from behind. The gap 98 assures appropriate fitting of the impact braces 96 when the anterior teeth 18 and their biting surfaces 19 are irregular. Thus, the impact braces 96 may readily shift upwardly, downwardly, inwardly together or opposingly apart.

The next injection molding shot is that of bite plate or reverse wedge 106 which is very hard and durable suitably made of high-density polyethylene (HDPE). A suitable high-density polyethylene is HD-6706 ESCORENE® injection molding resin from ExxonMobil Chemical Company, P.O. Box 3272, Houston, Tex. 77253-3272. This material is also very durable and has excellent bonding qualities and will not melt during the molding process as its melting point is 280° F. Thus, this material is hard enough so that it cannot be penetrated by the teeth under maximum biting pressure and thereby forms the bite plate or reverse wedge 106. The bite plate 106 on its lower surfaces has bosses or raised portions 108 with apertures 110 therethrough. The bosses 108 permit the bite plate 106 to be indexed into the index openings 94 of framework 86. The apertures 110 permit mechanical interlocking as will be appreciated with the next shot.

The traction pads 114 are the third shot and are created from elastomeric material. The traction pads 114 contact and grip the occlusal biting surfaces 49 of the posterior teeth 48 of the lower jaw and must be composed of a durable, resilient material which deforms somewhat when the jaws are closed and cushion the teeth 48 of the lower jaw 42.

The durable, resilient material of this layer or third shot comprises a mixture of styrene block copolymer and high-density polyethylene. More specifically, the styrene block copolymer may be DYNAFLEX® part number G2780-0001 from GLS Corporation, 833 Ridgeview Drive, McHenry, Ill. 60050 while the HDPE has been already described to be from ExxonMobil.

The durable resilient material of the traction pads 114 may include in another embodiment the styrene block copolymer and ethylene vinyl acetate (EVA). EVA is available from a number of sources, such as the ELVAX® resins from Dupont Packaging and Industrial Polymers, 1007 Market Street, Wilmington, Del. 19898. It is desirable that the durable resilient material have a Shore "A" hardness of approximately 82, which is very durable, yet rubbery.

In another embodiment of the traction pads 114, the styrene block copolymer may be mixed with polyolefin elastomer, which is a copolymer of ethylene and octene-1. A suitable copolymer is available as ENGAGE® from Dupont Canada, Inc., P.O. Box 2200, Streetsville, Mississauga, Ontarior L5M 2H3.

Another embodiment of the traction pads 114 may be a mixture of thermoplastic rubber and a polyolefin elastomer as described above. Suitably thermoplastic rubbers are SANTOPRENE® from Advanced Elastomer Systems, L.P., 388 South Main Street, Akron, Ohio 44311 and KRATON® Thermoplastic Rubber from the Shell Oil Company, Houston, Tex. Kraton® is composed of a styrene-ethylene/butylenes-styrene block copolymer and other ingredients. The exact composition of SANTOPRENE® is a trade secret.

Elastomeric traction pads 114 have upwardly projecting interlocking knob projections 116 which will pass through aperture 110 and lock the bite plate 110 and framework 86 together as may be appreciated in FIGS. 5, 10, 11, 11A and 12. The interlocking knob projections 116 suitably have a radius portion 118 to assure the mechanical interlock and to prevent the shearing away of the knobs 116 from the bite plate 106.

Also bucket lip or retaining lid 120 wraps around from the bottom exposed portion of pads 114 to the top of the bite plate 106 to again assure a sufficient mechanical interlock. The traction pads 114 also may have disconnected elastomeric adjustable anterior impact braces 122 with gap 124 therebetween braces 122 are in front of the anterior teeth 18 and have all of the adjustable customizable advantages of the impact braces 96 of framework 86. However, the impact braces 122 are softer than the framework braces 96 to assist in the dissipation of external forces.

The fourth shot of the mouthguard 70 comprises a encapsulation material 170 which is suitably softenable and forms the walls 70 and 74 and channel 78 as well as base 76 of the mouthguard 70. Thus, the softenable material comprises labial wall 172, lingual wall 174, and base 176. The material 170 has traction pad cutouts 177 to permit exposure of the traction pads 114 as it is undesirable to have the pads 114 encapsulated. The material 170 also forms channel 178 and palate arch 180 with its ruggae opening 182 which is suitable to permit the tongue 39 to contact the ruggae 43 to permit clear speech.

The softenable material 170 suitably comprises a mixture of EVA and polycaprolactone. A suitable polycaprolactone is TONE® Part No. Polymer P-767 from Union Carbide Corporation, 39 Old Ridgebury Road, Danbury, Conn. 06817-0001. However, the softenable material may consist of the polycapr alone as the possibility of ethylene vinyl acetate alone may also be utilized.

Another embodiment of the material 170 may be a mixture of polycaprolactone and the polyolefin elastomer. Preferably, the polyolefin elastomer is copolymer of ethylene and octene-1. A suitable copolymer is available as ENGAGE® from Dupont Canada, Inc., P.O. Box 2200 Streetsville, Mississauga, Ontario L5M 2H3.

An optional fifth shot of soft skin material 270 may be used. Material 270 may be ethylene vinyl acetate (EVA) as previously discussed to give a soft touch to the mouthguard 70 and to remove any hard or sharp edge feelings which may otherwise annoy the tongue, gums or mouth. The fifth layer of the soft EVA skin 270 includes labial wall 270, lingual wall 274, base 276 with traction pad cutouts 277 as was previously discussed. The EVA also has channel 278 and covers palate arch 280 excepting the ruggae opening 282.

The fourth and fifth shots of the softenable material 170 and soft EVA skin 270 may be combined in a single fourth shot of a low-density polyethylene having a short "D" hardness of approximately 45. It is believed that this is the first time that a mouthguard has been made out of a low-density polyethylene. A suitable material may be EXACT® Part No. 4023 from ExxonMobil Chemical. This material is ideal for the required softness. However, applicant has found that nucleating agents mixed with the low density polyethylene creates a slight shrinkage to assure that the encapsulating low-density polyethylene securely fits to the configuration of the mouth, teeth and gums. Such nucleating agents might be DIBENZYLIDINE SORBITOL of the polyol acetal chemical family sold by Milliken Chemical, 1440 Campton Road, Inman, S.C. 29349 under product name MILLAD® Part No. 3905. Another nucleating agent which creates slight shrinkage in the low-density polyethylene is from the sorbitol acetal family marketed under MILLAD® Part No. 3940 and has the chemical name bis(P-METHYLBENZYLIDENE) SORBITOL while another similar additive might be the MILLAD® Part No. 3988 known under the chemical name 3-4-DINEMETHYLBENZYLIDENE SORBITOL.

To fit the mouthguard 70 to the user's mouth, the mouthguard 70 is placed in hot water at about 211° F. (i.e., water that has been brought to a boil and taken off the heat) for about 15 seconds. The mouthguard is then removed from the hot water, and it will be very soft, but the framework 86 will hold the mouthguards general shape. Excess water is allowed to drain off the mouthguard 70 by holding it with a spoon or the like.

Next, the wearer carefully places the mouthguard in the mouth so that the interior portion of the appliance 70 touches or covers the eye teeth (the third set of teeth from the front) and extends backwardly toward the molars. Next, the wearer bites down firmly on the appliance and pushes the tongue against the roof of the mouth. The cross-cantilever connectors guide the upper molars 22 in position on plates 92. With a strong sucking motion, the wearer draws out all air and water from the mouthguard 70. The projections or knobs 116 of the traction pads 114 will index to the cusp 26 of the molars 22.

With a thumb, the wearer presses the bridge 88 and arch 80 tight against the roof of the mouth and then uses his hands and fingers to press the outside of the cheeks against the appliance 70 as the softenable material 170 oozes inwardly and outwardly to custom form the lingual and buccal walls 172 and 174 respectively. Because there are no rigid lingual or buccal walls in the appliance 70, the mouthguard 70 will fit any width of molar 22 or mouth.

The wearer retains the mouthguard in the mouth for at least one minute and, with the mouthguard still in the mouth, takes a drink of cold water. Next, the wearer removes the mouthguard 70 from the mouth and places it in cold water for about 30 seconds.

It is well known that illness, infection, tooth decay and/or periodontal disease is caused by bacteria, fungus, yeast, and virus. These microbials can grow and multiply on dental appliances when the appliances are being stored between uses as well as when the appliance is actually being worn or used.

Antimicrobial substances which are non-toxic and free of heavy metal for resisting the growth of the microbials may include chlorinated phenol (e.g. 5-CHLORO-2-(2,-4-DICHLOROPHENOXY)PHENOL), POLYHEXAMETHYLENE BIGUANIDE HYDROCHLORIDE (PHMB), DOXYCYCLINE, CHLORHEXIDINE, METRONIDAZOLE, THYMOL, EUCALYPOL and METHYL SALYCLATE. TRICLOSAN® from Siba Giegy of Switzerland is also available.

Dental appliances and mouthguards are suitably made of polymers. Incorporating the antimicrobial agent into the polymer during the manufacture of the mouthguard is achieved by incorporating the agent into the synthetic polymeric master batch. The antimicrobial agent is suitably placed into the batch in a concentration as high as 10% which will permit a let-down ratio resulting in the final concentration of the antimicrobial agent and the dental appliance of about .005 to about 2% by weight.

By encapsulating the antimicrobial agent into the polymer batch mix, the agents survive molten temperatures approximately or above 350° F. and thus the antimicrobial agent loses none of its biocidal properties in the formation of the mouthguard.

The present invention may be embodied in other specific forms without departing from the spirit or central attributes thereof; therefore, the illustrated embodiments should be considered in all respects as illustrative and not restrictive, reference being made to the appended claims rather than to the foregoing description to indicate the scope of the invention.

We claim:

1. A composite performance enhancing and force absorbing mouthguard having a U-shaped base with upstanding labial and lingual walls forming a channel, comprising:

(a) a nonsoftenable, flexible framework, comprising
  (i) posterior occlusal plates in the base;
  (ii) cross-cantilever connectors extending upwardly and inwardly from the plates; and
  (iii) expansible contractible bridge connected to upward portions of the connectors, the bridge being expansible and contractible to lie along a palate of a user; and (b) a softenable, customizable wall and channel material encapsulating the plates, connectors and bridge forming an arch from the connectors to an anterior portion of the lingual wall with a ruggae opening to facilitate speech and to custom fit the mouthguard to the mouth of the user without the mouthguard losing its shape during heating.

2. A composite performance enhancing and force absorbing mouthguard of claim 1, further comprising two hard, durable bite wedges located posteriorly along the occlusal plates, each wedge being thicker posteriorly than anteriorly.

3. A composite performance enhancing and force absorbing mouthguard of claim 1, further comprising two elastomer traction pads below the plates.

4. A composite performance enhancing and force absorbing mouthguard of claim 3, wherein the traction pads mechanically interlock the plates and the wedges to the pads.

5. A composite performance enhancing and force absorbing mouthguard of claim 3, further comprising elastomeric disconnected anterior impact braces extending forwardly from the pads in the ladial wall to an anterior region with a gap therebetween.

6. A composite performance enhancing and force absorbing mouthguard of claim 1, further comprising framework disconnected anterior impact braces extending forwardly from the plates in the lingual wall to an anterior region with a gap therebetween.

* * * * *